United States Patent [19]

Marathe

[11] 3,981,360

[45] Sept. 21, 1976

[54] WELL TUBING DRAIN

[75] Inventor: Anil Marathe, Long Beach, Calif.

[73] Assignee: Cook Testing Co., Long Beach, Calif.

[22] Filed: July 30, 1975

[21] Appl. No.: 600,213

[52] U.S. Cl. ..... 166/224 R; 137/70

[51] Int. Cl.[2] ..... E21B 33/16; E21B 33/134

[58] Field of Search ..... 166/224 R, 224 A; 137/70, 71, 467

[56] References Cited

UNITED STATES PATENTS

| | | | |
|---|---|---|---|
| 1,793,780 | 2/1931 | Daniel | 166/224 R |
| 2,647,727 | 8/1953 | Edwards | 166/224 R |
| 3,193,016 | 7/1965 | Knox | 166/224 R |
| 3,750,752 | 8/1973 | Mott | 166/224 R |
| 3,789,926 | 2/1974 | Henley et al. | 166/224 R |
| 3,878,889 | 4/1975 | Seabourn | 166/224 R |

*Primary Examiner*—James A. Leppink
*Attorney, Agent, or Firm*—Lyon & Lyon

[57] ABSTRACT

A well tubing drain including a ported mandrel interposed in the tubing string of a pumping well, and a sleeve initially covering and sealing the mandrel ports, the sleeve being subject to a predetermined internal fluid pressure applied through the ports to shear a retainer pin and cause motion of the sleeve to open the ports.

8 Claims, 4 Drawing Figures

WELL TUBING DRAIN

BACKGROUND

The field of this invention relates to sucker rod pumping wells. When the tubing string in such wells is being pulled for inspection, repair or replacement of the pump, fluid contained within the tubing is raised and as each section of the tubing string is disconnected, the fluid spills out creating a working and fire hazzard, unless means is provided at the well head to capture the fluid. Such means materially slows the tubing string pulling operation.

Attempts have been made to provide a subsurface drain in the tubing string which have met with only partial success, due to the problem of providing adequate flow area, particularly, if the fluid is highly viscous. Also, existing drain valves often reduce the available internal tubing area, limiting the size of pump.

SUMMARY

The present invention is directed to a well tubing drain which is summarized in the following objects:

First, to provide a well tubing drain wherein adequate openings for drainage of even high viscosity fluids may be accomplished, while maintaining a full tubing bore, and permitting passage of maximum diameter tubing string for a given casing size.

Second, to provide a well tubing drain which includes a novelly arranged annular piston means and shear pin subject to a predetermined fluid pressure internally of the tubing string above the normal pressures therein, to cause shearing of the pin and movement of the annular piston to open appropriate drain ports.

DETAILED DESCRIPTION

Figure 1:
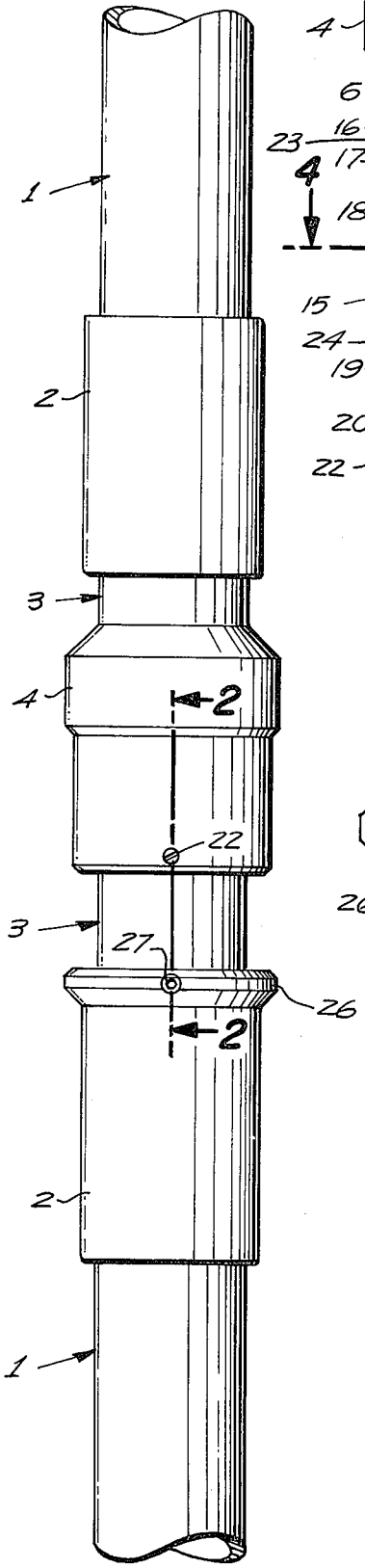
FIG. 1 is a side view of the well tubing drain as it appears when interposed in a tubing string, the adjacent sections of the tubing string being shown fragmentarily.

The well tubing drain is adapted to be interposed between adjacent tubing sections 1, having collars 2. The well tubing drain includes a mandrel 3, having externally screwthreaded ends adapted to be received in the collars 2. Adjacent its upper end, the mandrel is provided with a guard flange 4. Formed in he underside of the guard flange 4, is a short cylindrical portion 5 terminated at its underside by a shoulder 6. Extending downwardly from the shoulder 6 is an upper seal ring receiving surface 7. Continuing therefrom, the mandrel is reduced further to form a relieved portion 8.

Penetrating the relieved portion 8 is a pair or more or radial drain ports 9. Continuing from the relieved portion 8, there is a second shoulder 10. Continuing from the shoulder is a lower seal ring receiving surface 11 and continuing from this surface there is a relieved portion 12, provided with one or more shear pin sockets 13. Continuing downwardly from the relieved portion 12 is a further or final relieved portion 14 which continues to the lower screwthreaded end of the mandrel.

Received on the mandrel 3 is a piston sleeve 15, having at its upper extremity a counter bore forming an upper seal ring receiving surface 16, terminating in a shoulder 17, confronting the shoulder 6, continuing downwardly form the shoulder 17, the sleeve forms a port covering surface 18 which clears the relieved portion 8 and its lower portion forms a seal receiving surface terminating in a shoulder 19. Spaced downwardly from the shoulder 19 is a shear pin receiving portion 20, the inner surface of which slideably engages the relieved portion 12.

The shear pin receiving portion 20 receives one or more shear pins 21, having screwthreaded outer portions 22. The inner ends of the shear pins are received in the sockets 13.

Fitted between the surfaces 7 and 16 is an upper seal ring 23. Fitted between the surface 11 and the lower end of the surface 18 is a seal ring 24, adjacent the seal rings 23 and 24 are washer rings 25 which confront the shoulders 6, 10, 17 and 19.

Secured to the final relieved portion 14, adjacent the lower collar 2, is a sleeve retension and guard ring 26 held in place by a set screw 27.

Figure 2:
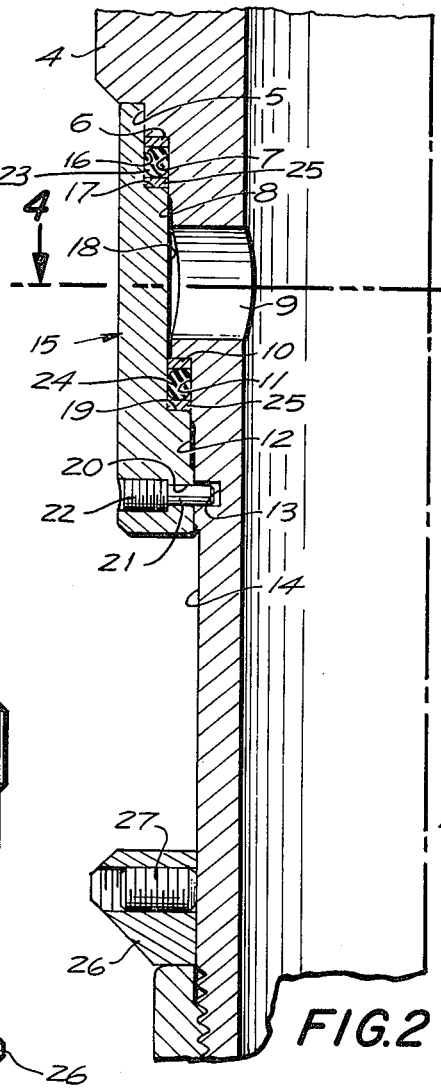
FIG. 2 is an enlarged fragmentary half sectional view thereof, taken through 2—2 of FIG. 1, showing the well tubing drain in its closed position.
Figure 3:
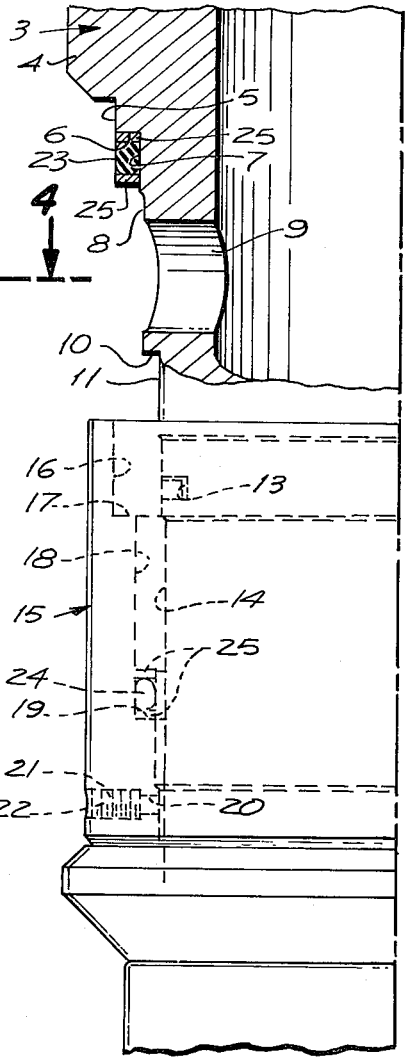
FIG. 3 is a similar sectional view with portions shown in elevation, showing the well tubing drain in its open position.
Figure 4:
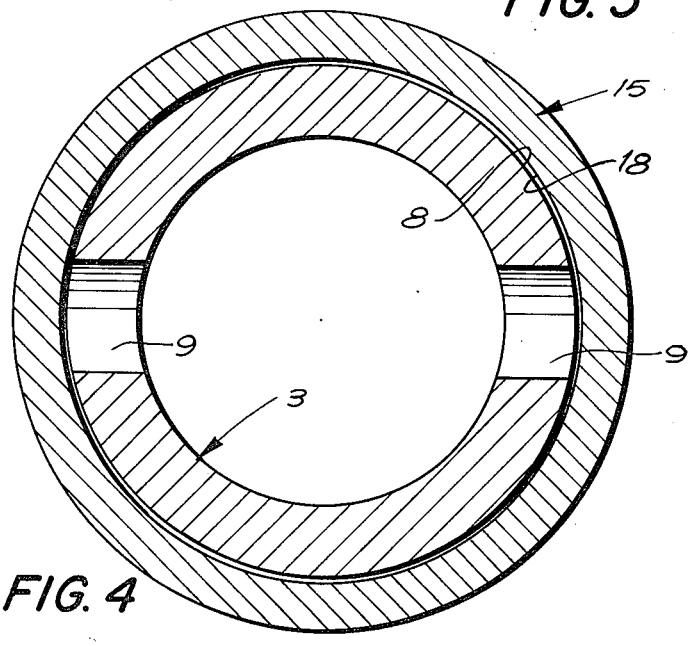
FIG. 4 is a transverse sectional view taken through 4—4 of FIG. 2.

Operation of the well tubing drain is as follows:

The initial or closed position of the well tubing drain is shown in FIGS. 1, 2 and 4, in which the mandrel is sealed by the piston sleeve 15 and seal rings 23 and 24 disposed above and below the drain ports 9. When it is desired to open the drain ports 9, fluid pressure is applied to the tubing string, which pressure is applied to the shoulder 10 and the confronting washer ring 25 of the lower O-ring seal and also between the upper shoulder 16 and its confronting washer ring 25. It should be noted that these washer rings do not form a sealing contact with their respective shoulders 6 and 10. For this purpose, the confronting surface may be roughened.

Pressure applied to the drain ports is applied directly to the upper shoulder 6 and indirectly to the lower shoulder 10 to the lower O-ring. The pressure applied to calculated to produce a downward force sufficient to shear the shear pin 21, or set of shear pins. When the shear pin or pins are severed, the resistance to movement is suddenly relieved, causing sudden downward movement of the sleeve. As soon as the seals confront the relieved portions 8 and 12 and the shear pin or pins 21 confront the final relieved portion 14, friction between the piston sleeve and the mandrel is eliminated so that the sleeve falls freely. It should be noted that even though the tubing string may be in cotact with the wall of the surrounding casing, that the guard flange 4 and guard flange 26 protect the sleeve from contact with the casing.

It should be noted that the shearing pressure required in the tubing string is usually substantially higher than the pressure of fluid surrounding the tubing string, so that once the upper end of the sleeve is exposed to the pressure in the tubing string, there is a residual downward force tending to effect complete opening of the drain ports 9. Also, any upward acceleration or deceleration will have the effect of supplementing the gravitational force tending to move the sleeve downward until it engages the guard ring 26.

While it is preferred to provide the guard flange 4 and guard ring 26, it should be noted that if the sleeve constituted the major diameter portion of the well tubing drain and the tubing string so that the sleeve engages the surrounding the casing, upward movement of the tubing drain and the tubing string so that the sleeve engages the surrounding the casing, upward movement of the tubing string would cause the sleeve to drag on the surrounding wall and force the sleeve downward, once the pins 21 are sheared.

While, with the seal arrangement shown, the effective pressure area is the sum of the two seals, either seal may be set in a channel provided in the mandrel or piston sleeve with, of course, corresponding reduction in the effective piston area.

Having fully described my invention it is to be understood that I am not to be limited to the details herein set forth, but that my invention is of the full scope of the appended claims.

I claim:

1. A drain for a well tubing string, comprising:

a. a tubular mandrel member having at least one lateral port and adapted to be interposed between sections of a tubing string;

b. an axially movable annular sleeve member surrounding the mandrel member;

c. at least one shear pin connecting the sleeve and mandrel to restrain the sleeve against axial displacement;

d. a pair of axially spaced annular seal means disposed between the sleeve member and mandrel member isolating and sealing the port each of the seal means presenting a pressure responsive area, and one being of larger diameter than the other whereby both pressure areas are operable to apply a shearing load in the same direction on the shear pin;

e. and at least one of the seal means presenting an axially directed annular pressure responsive area, exposed to the interior of the mandrel member through the port and responsive to a predetermined fluid pressure in the mandrel member to exert a shearing load on the shear pin permitting downward axial displacement of the sleeve member to expose the port.

2. A drain for a tubing string, as defined in claim 1, wherein:

a. a stop ring is secured to the mandrel member in spaced relation to the sleeve member to limit axial displacement thereof.

3. A drain for a tubing string as defined in claim 1, wherein:

a. the shear pin includes a screwthreaded radially outer portion secured adjacent the lower end of the sleeve member below the seal means, and the sleeve member occupies initially an upper position with respect to the mandrel member;

b. and the mandrel member includes a region of reduced external diameter immediately below the shear pin, whereby upon initial downward movement of the sleeve member, the sheared radially inner end of the shear pin clears the mandrel member.

4. A drain for a tubing string, as defined in claim 3, wherein:

a. on predetermined travel of the sleeve member the seal means are disengaged from one of the members to eliminate frictional restraint between the members due to the seal means.

5. A drain for a tubing string, as defined in claim 1, wherein:

a. the mandrel member is provided with peripheral shoulders above and below the sleeve member for contact with a surrounding casing to prevent contact of the sleeve member with the casing.

6. A drain for a well tubing string, comprising:

a. a tubular mandrel member having means at its extremities for interposing the mandrel member between sections of the tubing string, said mandrel member having at least one radial drain port intermediate its ends;

b. an axially movable annular sleeve member surrounding the mandrel member and adapted to occupy an upper position covering the drain port;

c. at least one shear pin joining the sleeve member and mandrel member to secure the sleeve member in its upper position;

d. seal means between the mandrel member and sleeve member above and below the drain port;

e. and annular piston means associated with at least one of the seal means exposed to pressure in the mandrel member and tubing string and adapted to exert an axial force, when subjected to a predetermined pressure, to shear the shear pin and permit downward movement of the sleeve member to open said drain port.

7. A drain for a well tubing string, as defined in claim 6, wherein:

a. a pair of annular piston means is provided.

8. A drain for a well tubing string as defined in claim 6, wherein:

a. confronting portions of the mandrel member and sleeve member are disposed in spaced relation following initial movement of the sleeve member to shear the shear pin whereby the sleeve member is free to fall by gravity and supplementary downward forces applied to the sleeve upon upward movement of the tubing string and mandrel member, thereby to aid in effecting full opening of the drain port.

* * * * *

UNITED STATES PATENT AND TRADEMARK OFFICE

CERTIFICATE OF CORRECTION

PATENT NO. : 3,981,360

DATED : September 21, 1976

INVENTOR(S) : Anil Marathe

It is certified that error appears in the above-identified patent and that said Letters Patent are hereby corrected as shown below:

Column 1, line 62, the last "or" should read --of--.

Column 2, line 8, "form" should read --from--.

Column 2, line 44, "to calculated" should read --is calculated--.

Column 2, line 53, "contact" is misspelled.

Column 3, line 3, delete "the" second occurrence.

Column 3, delete lines 4 and 5.

Column 3, line 6, delete "of" at the beginning of the line.

Signed and Sealed this

Seventh Day of December 1976

[SEAL]

*Attest:*

RUTH C. MASON
*Attesting Officer*

C. MARSHALL DANN
*Commissioner of Patents and Trademarks*